US005662500A

United States Patent [19]

Yeah

[11] Patent Number: 5,662,500

[45] Date of Patent: Sep. 2, 1997

[54] PLUG-AND-SOCKET POWER CONNECTOR

[76] Inventor: Solomon Yeah, 20th Fl., No. 105, Sec. 2, Tunhwa S. Rd., Taipei, Taiwan

[21] Appl. No.: 629,233

[22] Filed: Apr. 8, 1996

[51] Int. Cl.[6] ..... H01R 15/00

[52] U.S. Cl. ..... 439/732; 439/181

[58] Field of Search ..... 439/732, 680, 439/101, 284, 181, 186, 825

[56] References Cited

U.S. PATENT DOCUMENTS

| | | | |
|---|---|---|---|
| 4,193,655 | 3/1980 | Hermann, Jr. | 439/732 |
| 4,364,626 | 12/1982 | Price | 439/732 |
| 5,015,195 | 5/1991 | Piriz | 439/825 |
| 5,131,858 | 7/1992 | Heimbrock | 439/181 |
| 5,248,268 | 9/1993 | Rinker | 439/732 |

*Primary Examiner*—Hien Vu
*Attorney, Agent, or Firm*—Bacon & Thomas

[57] ABSTRACT

A power connector comprises a plug mechanism and a socket mechanism. The plug mechanism is provided with a plurality of insulating tubes designed to enclose and arranged to be spaced around respective pinning mechanism. The socket mechanism of the connector is provided with corresponding holes for the tubes, tubular conductors for the pinning mechanism, and a housing element for partially receiving the plug mechanism, whereby when the pinning means are inserted into the holes, sparks, in case there are, will be kept apart from a person' hand by both the insulating tubes and the housing element.

4 Claims, 2 Drawing Sheets

PLUG-AND-SOCKET POWER CONNECTOR

THE FIELD OF THE INVENTION

This invention relates to a safety plug-and-socket power connector, more particularly, to a plug-and-socket power connector which is of high safety.

THE BACKGROUND OF THE INVENTION

Conventional power plugs are substantially composed of a insulating material, except for the conducting pins which are exposed so that they may be inserted into a socket when in use. There is no problem for such plugs to be employed with 110 voltage. As to 220 voltage or more, however, even with the slightest initial contact of the pins with the socket, a high contact voltage or electrical sparks may be generated, which in fact will shock a person who has a sight of the sparks while his hand at that time is pushing the plug, or furthermore, will kill the person if his hand is close enough to the pins.

SUMMARY OF THE INVENTION

The object of present invention is to provide a plug-and-socket power connector which eliminates exposure of electrical sparks to a person and fulfills the safety requirement so there is no danger of electrical shock.

To achieve the object above, there is provided with a plug-and-socket power connector which includes a plug means comprising a back end and a forward end, a plurality of tubes made of insulating material extending longitudinally from the forward end, and pinning means also extending from the forward end but spaced respectively within the tubes, each pinning means having a distal end, an insulating head at the distal end, and a plurality of flexible strips curved radially outward at a middle portion thereof; and a socket means comprising a front end and a rear end, a housing element recessed at the front end for partially receiving the plug means, and a supporting body located behind and adapted to support the housing element; said supporting body having a plurality of holes extending longitudinally backward, and tubular conductors each spaced within respective conductors for allowing one of the pinning means of the plug means to be inserted in separately while the tubes of the plug means being held between the holes and the conductors; whereby when the pinning means are being inserted into the holes, the insulating head comes into contact with the tubular conductor prior to the flexible strips which may discharge electrical sparks during their moving in contact against the conducts as the plug means is further pushed forward with its forward end entered the housing of the socket means so that the sparks are kept apart from a person's hand by both the insulating tubes as well as the housing.

Other object of this invention will be more apparent from the descriptions which follow.

BRIEF DESCRIPTIONS OF THE DRAWINGS

DETAILED DESCRIPTION OF THE PREFERRED EMBODIMENT

Figure 1:
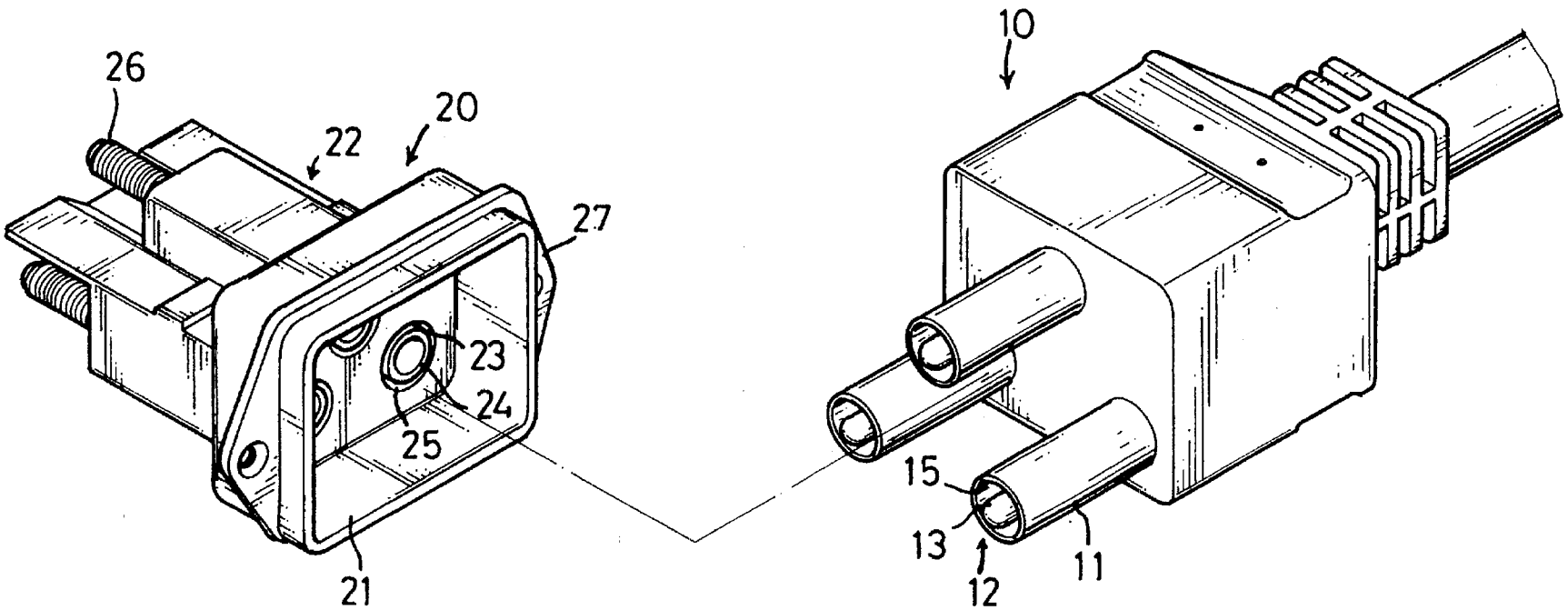
FIG. 1 is a perspective view of the present invention.

As shown in FIG. 1, a plug-and-socket power connector includes a plug means 10 which comprises a back end and a forward end. A plurality of tubes 11 made of insulating material extend longitudinally from the forward end, and so do a plurality of pinning means 12 of which each is spaced within a respective tube 11 in such a way that a first interspace 15 is formed between the pinning means 12 and the tube 11. Each pinning means has a distal end, an insulating head 13 at the distal end, and a plurality of flexible strips 14 curved radially outward at a middle portion thereof, as best shown in FIG. 2.

A socket means 20 comprises a front end and a rear end. A housing element 21 with insulation sides is formed at the front end for partially receiving the plug means 10. A supporting body 22 is located behind and adapted to support the housing element 21. The supporting body 22 is substantially solid, except that there are a plurality of first holes 23 extending longitudinally inward as well as a plurality of tubular conductors 24, each being spaced within the respective holes 23 in such a way that a second interspace 25 is formed between the tubular conductors 24 and the hole 23, for allowing one of the pinning means 12 of the plug means 10 to be inserted therein separately while the tubes 11 of the plug means 10 are held in the interspace 25. The tubular conductors 24 also extend from and are exposed at the rear end of the socket means 20 to form terminal ends 26 for attaching with cords of an appliance.

It is noticeable in the same figure that at opposite sides of the housing element 21 there are provided two ears 27, each respectively with a second hole defined therein whereby the socket means 20 can be attached to an outer surface of the appliance.

Figure 2:
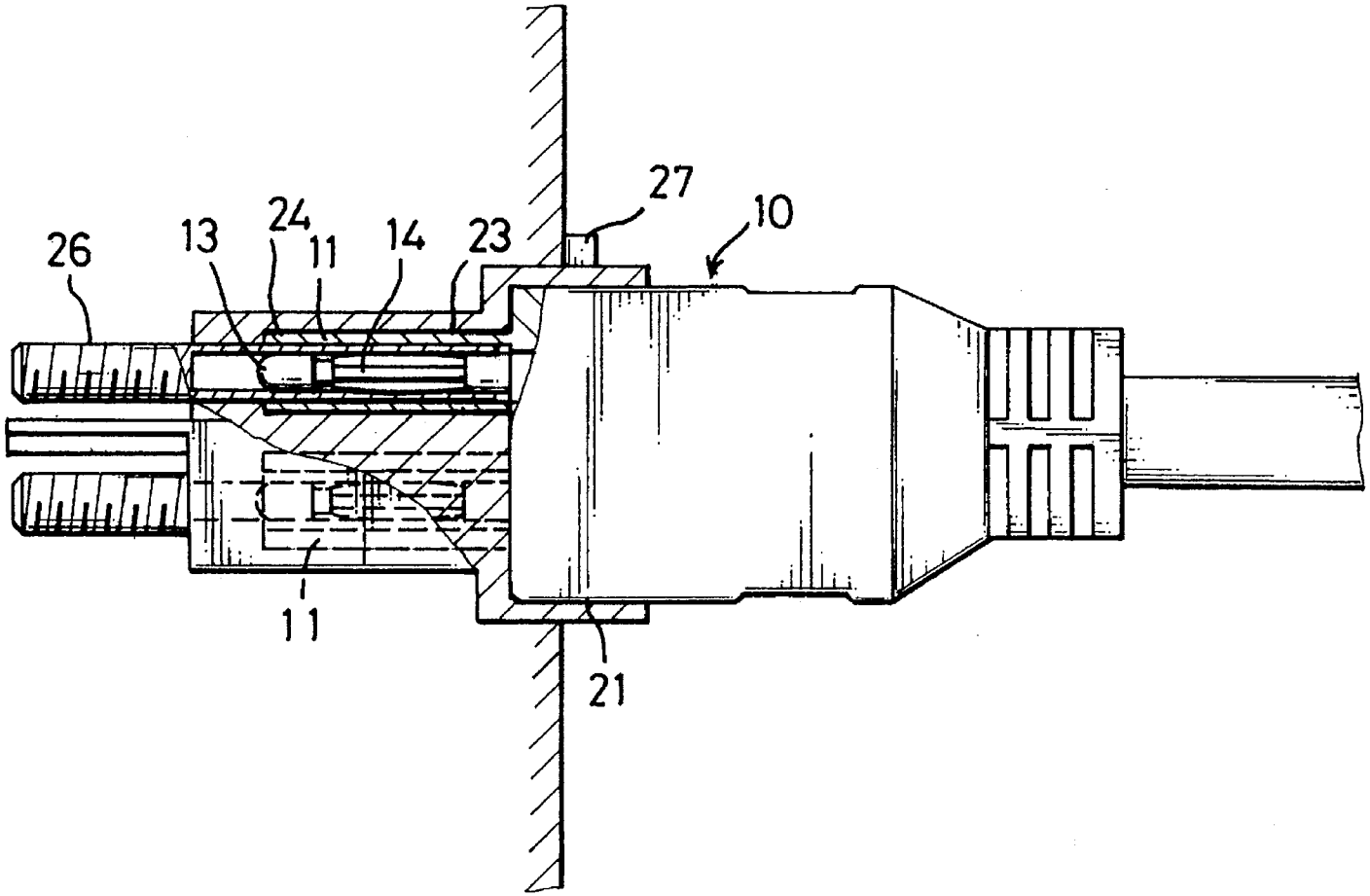
FIG. 2 is a view showing an assembly of the present invention.

As shown in FIG. 2, when the power connector is in use, it is easier for the pinning means 12 and the tubes 11 to be aligned with corresponding tubular conductors 24 and the interspacer 25 by virtue of the housing element 21. The flexible strips 14 which may discharge electrical sparks during their moving do not contact with the conductors 24 until the plug means 10 is further pushed forward so that its forward end enters the housing element 21 of the socket means 20, therefore, the sparks, will be kept apart in any way from a person's hand by both the insulating tubes 11 and the housing element 21.

While the principles of this invention have been described in connection with its embodiment, it should be understood that many other possible modifications and variations can be made without departing from the spirit and scope of the invention as hereinafter claimed.

What is claimed is:

1. A plug-and-socket power connector comprising:

a plug having a back end and a forward end, a plurality of tubes made of insulating material extending longitudinally from the forward end, and a plurality of pins extending from the forward end, each pin enclosed within one of the plurality of tubes, each pin having a distal end, an insulating head at the distal end, and a plurality of flexible contact strips each curved radially outward at a middle portion thereof disposed within the associated tube; and, a socket having a front end and a rear end, a housing element located at the front end forming a recess at the front end configured to receive at least a portion of the forward end of the plug therein, and a supporting body located behind and supporting the housing element, said supporting body having a plurality of holes extending longitudinally therethrough, a tubular conductor in each hole, each tubular conductor spaced from a wall bounding the hole, each tubular conductor configured to receive a pin of the plug while the tubes of the plug means extend into the space between the walls bounding the holes and the conductors; whereby the flexible contact strips are located such that they contact the tubular conductors only after at least a portion of the forward end of the plug is received in the recess of the housing element of the plug and wherein the insulating head contacts the tubular conductor prior to the flexible contact strips moving into contact with the conductors as the plug means is pushed into the socket.

2. The plug-and-socket power connector as in claim 1 wherein the housing is made of insulating material.

3. The plug-and-socket power connector as in claim 1 wherein the tubular conductors extend from the rear end of the socket to form terminal ends.

4. The plug-and-socket power connector as in claim 1 wherein the supporting body is substantially solid.

* * * * *